US011498355B2

(12) United States Patent
Lazar

(10) Patent No.: US 11,498,355 B2
(45) Date of Patent: Nov. 15, 2022

(54) COMBINATION GREETING CARD

(71) Applicant: Notocard LLC c/o Neiman & Mairanz P.C., New York, NY (US)

(72) Inventor: Chanie Lazar, Lawrence, NY (US)

( * ) Notice: Subject to any disclaimer, the term of this patent is extended or adjusted under 35 U.S.C. 154(b) by 0 days.

(21) Appl. No.: 16/620,202

(22) PCT Filed: Jun. 6, 2018

(86) PCT No.: PCT/US2018/036283
§ 371 (c)(1),
(2) Date: Dec. 6, 2019

(87) PCT Pub. No.: WO2018/226849
PCT Pub. Date: Dec. 13, 2018

(65) Prior Publication Data

US 2021/0078351 A1 Mar. 18, 2021

Related U.S. Application Data

(60) Provisional application No. 62/515,798, filed on Jun. 6, 2017.

(51) Int. Cl.
*B42D 15/02* (2006.01)
*B42D 15/00* (2006.01)
(Continued)

(52) U.S. Cl.
CPC ..... *B42D 15/022* (2013.01); *B42D 15/0086* (2013.01); *B42D 15/0093* (2013.01);
(Continued)

(58) Field of Classification Search
CPC ..... B42D 15/022; B42D 15/02
(Continued)

(56) References Cited

U.S. PATENT DOCUMENTS 4,931,629 A * 6/1990 Frankfurt ..... B42D 25/373 235/488
5,364,482 A 11/1994 Morikawa et al.
(Continued)

FOREIGN PATENT DOCUMENTS

CN 2217512 Y 1/1996
CN 202186150 U 4/2012
(Continued)

OTHER PUBLICATIONS

Office Action for EA Application No. 202090013, Eurasian Patent Office, dated Oct. 4, 2021 (2 pages).
(Continued)

*Primary Examiner* — Kyle R Grabowski
(74) *Attorney, Agent, or Firm* — FisherBroyles, LLP

(57) ABSTRACT

The present invention discloses a greeting card having at least two surfaces and at least three edges, the greeting card comprising an intrinsically valuable base material comprising titanium or a titanium alloy and one or more gemstones embedded on one or more of the surfaces or edges; wherein the greeting card has a thickness of between about 1.0 mm and about 1.5 mm, a first dimension between about 70 mm and about 90 mm, and a second dimension between about 50 mm and about 60 mm; and further wherein the greeting card depicts one or more of a letter, number, symbol, artistic design, image, or message.

25 Claims, 16 Drawing Sheets

Figure 1:
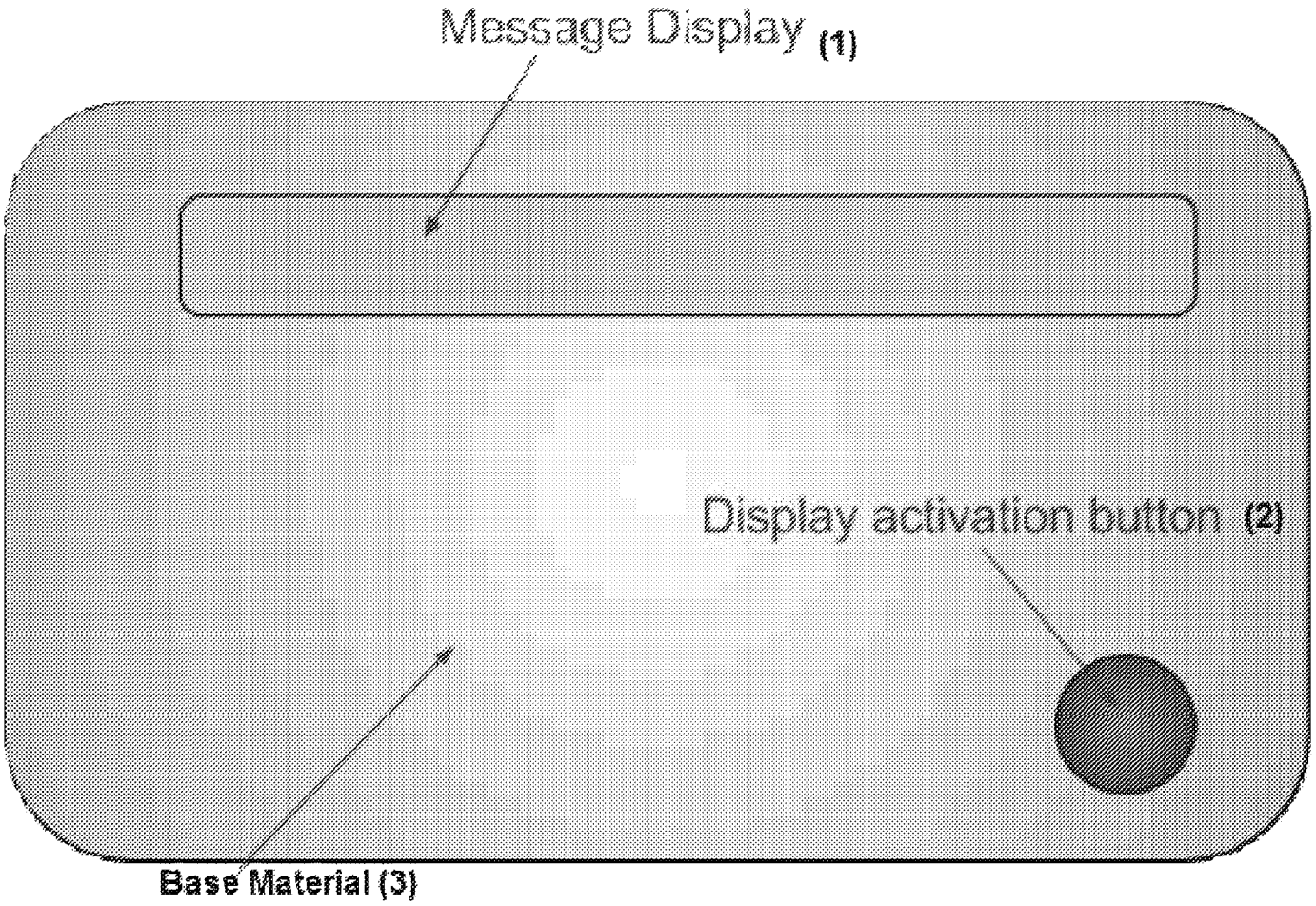

(51) Int. Cl.

| | |
|---|---|
| ***G09F 9/30*** | (2006.01) |
| *B42D 15/04* | (2006.01) |
| *B44C 1/18* | (2006.01) |
| *B44C 1/22* | (2006.01) |

(52) U.S. Cl.
CPC ..... *B42D 15/02* (2013.01); *G09F 9/30* (2013.01); *B42D 15/042* (2013.01); *B44C 1/18* (2013.01); *B44C 1/225* (2013.01); *B44C 1/227* (2013.01); *B44C 1/228* (2013.01)

(58) Field of Classification Search
USPC ..... 40/124.02
See application file for complete search history.

(56) References Cited

U.S. PATENT DOCUMENTS

| | | | | |
|---|---|---|---|---|
| 5,979,942 | A | 11/1999 | Ivicic | |
| 6,093,273 | A | 7/2000 | Lee | |
| 6,450,402 | B1 | 9/2002 | Regev | |
| 8,950,093 | B2 | 2/2015 | Mandelbaum et al. | |
| 9,335,109 | B2 | 5/2016 | Bensayan et al. | |
| 2006/0086802 | A1* | 4/2006 | Tolkowsky | B42D 25/46 235/487 |
| 2007/0136085 | A1 | 6/2007 | Wagner et al. | |
| 2009/0294543 | A1 | 12/2009 | Varga et al. | |
| 2010/0164836 | A1 | 7/2010 | Liberatore | |
| 2010/0175287 | A1 | 7/2010 | Gupta et al. | |
| 2011/0192907 | A1* | 8/2011 | Galili | G06K 19/00 235/487 |
| 2011/0247247 | A1* | 10/2011 | Mayer | B42D 15/042 40/124.03 |
| 2011/0295691 | A1 | 12/2011 | Krieter | |
| 2012/0011751 | A1 | 1/2012 | Schimke et al. | |
| 2014/0169599 | A1* | 6/2014 | Solum | H04R 25/554 381/315 |
| 2015/0019518 | A1 | 1/2015 | Buchanan | |
| 2015/0069131 | A1* | 3/2015 | Scanlon | B42D 25/425 235/487 |
| 2015/0336415 | A1* | 11/2015 | Fetters | G09F 1/04 40/124.09 |
| 2017/0031346 | A1 | 2/2017 | Kessinger | |
| 2017/0043607 | A1* | 2/2017 | Seadler | B42D 15/022 |

FOREIGN PATENT DOCUMENTS

| | | | | |
|---|---|---|---|---|
| DE | 2737164 | A1 | 2/1979 | |
| JP | H04033583 | U | 3/1992 | |
| JP | H1058871 | U | 3/1998 | |
| JP | 2009274342 | A | 2/2013 | |
| WO | WO-9916626 | A2 * | 4/1999 | B42D 15/02 |
| WO | WO-0128782 | A1 * | 4/2001 | B42D 15/02 |
| WO | 201659415 | A1 | 4/2016 | |

OTHER PUBLICATIONS

First Examination Report for IN Application No. 202037000381, Indian Patent Office, dated Sep. 1, 2021(6 pages).
Office Action for JP Application No. 2019-568239, Japanese Patent Office, dated May 24, 2022 (6 pages).
web.archive.org/web/20121102105020/https://www.techopedia.com/definition/24426/real-time-communications-rtc, Real-Time Communications (RTS), crawled in 2012 (5 pages).
English Translation of Office Action for JP Application No. 2019-568239, Japanese Patent Office, dated May 24, 2022 (6 pages).
Office Action for AU Application No. 2018280143, Australian Patent Office, dated Jun. 2, 2022 (7 pages).

* cited by examiner

TOP MEASUREMENT VIEW

BOTTOM MEASUREMENT VIEW

| CARD MATERIAL | TITANIUM |
|---|---|
| [illegible] | [illegible] |
| EDGES | MIRROR POLISHED FINISH |
| TEXT | MIRROR POLISHED FINISH |
| FILES NEEDED | CARD TYPEFIT.STP<br>CARD TYPEFIT_TEXT.EPS |

| | |
|---|---|
| CARD MATERIAL | SILVER PLATED TITANIUM |
| SURFACE FINISHING | SILVER PLATED<br>MICRO SEAD-PLATED FINISH |
| EDGES | MIRROR POLISHED FINISH |
| TEXT | MIRROR POLISHED FINISH |
| FILES REF. | CARD TYPES.ZTP<br>CARD TYPES_TEXT.SRC |

COMBINATION GREETING CARD

I. BACKGROUND

The greeting card industry is a competitive industry where attempts are constantly made to produce novel greeting cards. However, the greeting card industry suffers from several issues thought to be inherent to the industry. For example, after a person has received a greeting card, they are typically soon simply discarded and the message which was contained in the greeting card is lost, forgotten, or ignored. Even when greeting cards are saved, they are typically stored in a box or other protective casing because their traditional materials (e.g., paper) make them relatively fragile to daily use. Thus, typical greeting cards have limited effectiveness as long lasting methods of communication of human sentiments between individuals. There is a need for novel greeting cards that have an intrinsic gift value that will be kept so that the message that was originally conveyed is preserved, as well as for greeting cards that have ongoing functional utility.

II. SUMMARY OF THE INVENTION

The present disclosure relates to a novel greeting card which also has an intrinsic value, as well as novel greeting cards which possess ongoing functional utility. By providing a greeting card which has an intrinsic value, the underlying value and gift may be combined with the greeting card, an advantage over traditional greeting cards. In certain embodiments, the greeting cards of this disclosure comprise combinations and arrangements of one or more of the following: a base material comprised of metal, metal alloy, composite material, or other durable material which may also carry intrinsic value; engraving or embossment on the base material; embedded or affixed gemstones or precious metals; and electronic features, such as an electronic text display, video display, or audio device.

In some embodiments, the greeting card is comprised of a base material and at least one gemstone embedded in the base material. In some embodiments, the greeting card is comprised of a base material and a plurality of gemstones embedded in the base material. In preferred embodiments, the plurality of gemstones are embedded in the base material in a pre-determined fashion. This can be in addition to other engravings.

The base material comprises metal, metal alloy, composite material, or other durable material which may also carry intrinsic value. In a preferred embodiment, the base material comprises titanium or a titanium alloy. In other preferred embodiments, the base material comprises precious metals, such as silver, gold, or platinum or their alloys. Those skilled in the art will recognize that other metals suitable for formation into the shape of a greeting card of the present invention may be utilized, such as aluminum, brass, chromium, cobalt, iron, inconel, manganese, molybdenum, steel, titanium, tungsten, vanadium, related compositions, and combinations thereof. The base material may also comprise composite materials, including reinforced plastics, metal composites, and ceramic composites. An example of a suitable composite is carbon fiber.

In some embodiments, the base material is surface-coated. In some embodiments, the base material is, silver-plated, gold-plated, nickel-plated, palladium-plated, platinum-plated, rhodium-plated, or zinc-plated. In some embodiments, the base material is polymer-coated, plastic-coated, resin-coated, acrylic-coated, vinyl-coated, or painted. In preferred embodiments, the base material is coated with PVD. In some embodiments, the base material is finished. In some embodiments, the base material is polished, buffed, ground, or blasted. In preferred embodiments, the base material is microbead-blasted or mirror polished. In some embodiments, the greeting card is engraved. In some embodiments, the greeting card is engraved by a laser, acid etching, or mechanical means.

In some embodiments, the greeting card comprises a plurality of gemstones embedded in the greeting card. In some embodiments, the plurality of gemstones is embedded in one or more sides of the greeting card. In some embodiments, the gemstone comprises a precious gemstone. In other embodiments, the gemstone comprises a semi-precious gemstone. In some embodiments, the gemstone comprises a diamond, sapphire, ruby, emerald, pearl, or other related gemstone. In preferred embodiments, the gemstone comprises a pink diamond or diamonds or another natural or non-natural colored diamond or diamonds.

In some embodiments, the greeting card comprises at least one electronic component. In some embodiments, the at least one electrical component is located on one or more sides of the greeting card. In some embodiments, the at least one electronic component comprises one of an antenna, speaker, headphone jack, near field communication (NFC) device, radio-frequency identification (RFID) tag/chip, Wi-Fi dongle, microphone, Bluetooth adapter/dongle, Bluetooth low energy (BLE), solar cell, fingerprint sensor, LED light/flashlight, laser, camera lens, display screens, and activation button. In some embodiments, the greeting card comprises cellular data capabilities. In some embodiments, the display screen comprises an electrioic ink (E-ink) display screen. In some embodiments, the greeting card further comprises at least one additional electrical components. In some embodiments, the electrical components are interconnected with one another through wiring or circuitry. In some embodiments, the greeting card further comprises at least one memory storage device. In some embodiments, the memory device is interconnected to at least one additional electrical component. In some embodiments, the greeting card further comprises a battery. In some embodiments, the battery is interconnected to at least one electrical component. In some embodiments, the battery is rechargeable or non-rechargeable. In some embodiments, the greeting card further comprises an I/O port. In some embodiments, the I/O port is a USB port. In some embodiments, the greeting card further comprises a charging port.

In some embodiments, the greeting card has a thickness of about 0.5 to about 5.0 mm, about 0.75 to about 4.0 mm, about 1.0 mm to about 1.5 mm, about 0.75 to about 1.5 mm, about 1.0 mm to about 2.0 mm, about 0.75 to about 2.0 mm, about 1.5 to about 2.0 mm, and any intervening ranges therein. In a preferred embodiment, the greeting card has a thickness of about 1.2 mm to about 1.3 mm. In some embodiments, the greeting card has an overall geometric shape. In preferred embodiments, the overall shape is a rectangle with rounded edges. In some embodiments, the overall shape is one of a rectangle, square, triangle, including equilateral, isosceles, scalene, right, obtuse, and acute, rhombus, parallelogram, trapezoid, kite, trapezium, pentagon, hexagon, heptagon, octagon, nonagon, decagon, circle, ellipse, crescent, or any other regular or irregular polygon. In some embodiments, the greeting card in generally in the shape of a regular polygon, such as a rectangle, with one or more protruding tabs on one or more edges of the greeting card. The greeting card may additionally have an aperture, which may be on the protruding tab or elsewhere, to enable the card to be attached to another object. The protruding tab may also be decorated, and may function to aid in the removal of the card from a wallet, purse, or other carrying case. In a preferred embodiment the greeting card is a flat shape of the foregoing dimensions having only two sides (i.e., a front side and back side). In other embodiments, the greeting card may be folded or bent, such as in the shape of a traditional paper greeting card (e.g., two rectangular panels connected on one side) or any other multi-dimensional shape.

III. BRIEF DESCRIPTION OF THE FIGURES

FIG. 1 relates to an exemplary greeting card having an overall rectangular shape, a display screen (1), display activation button (2), and base material (3).

Figure 2B:
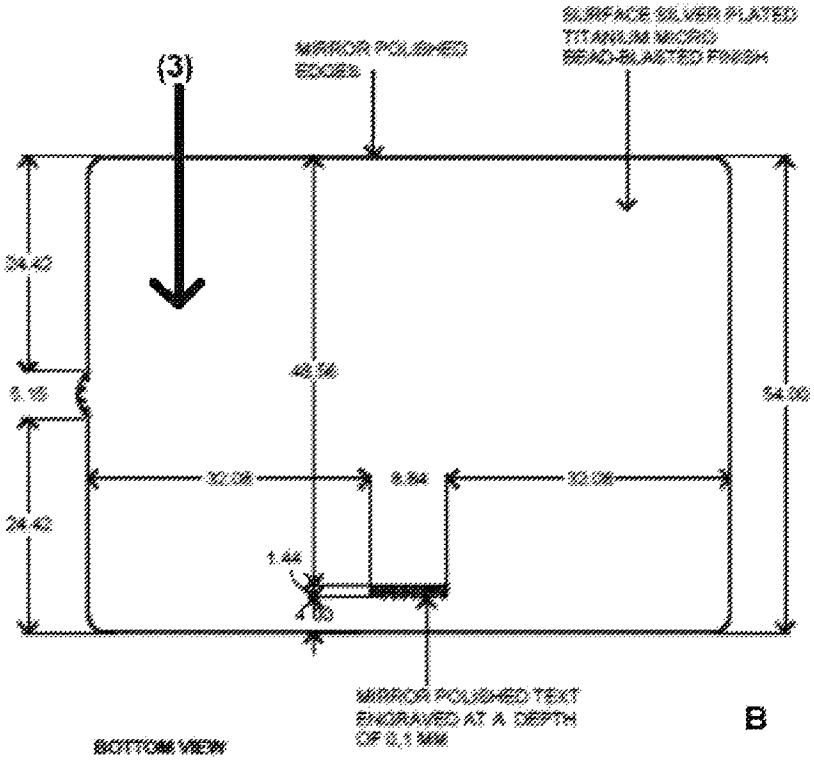
Figure 2A:
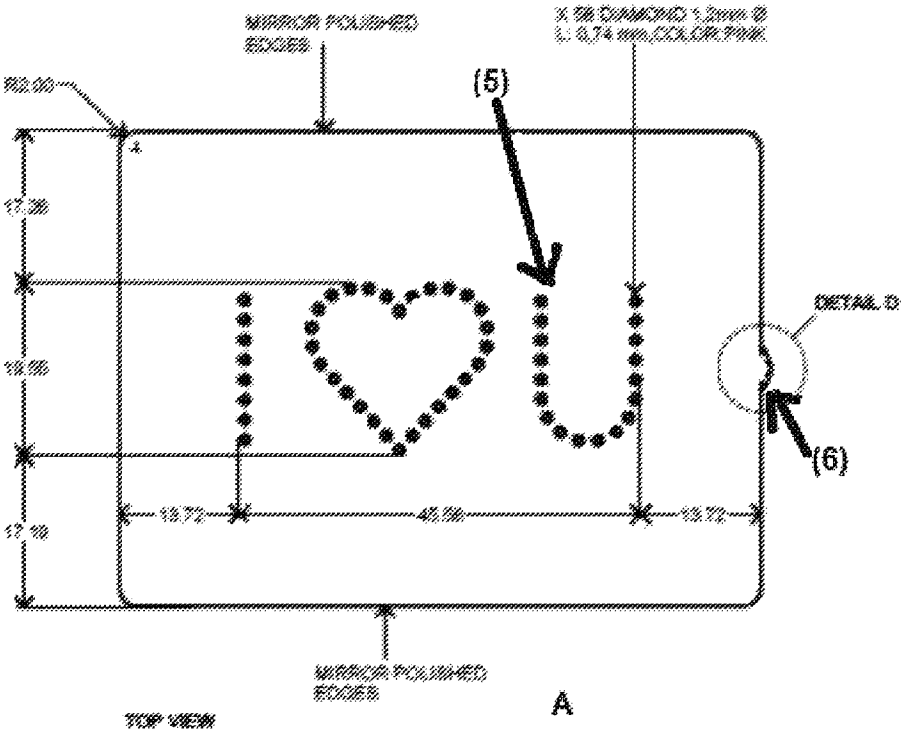
Figure 2C:
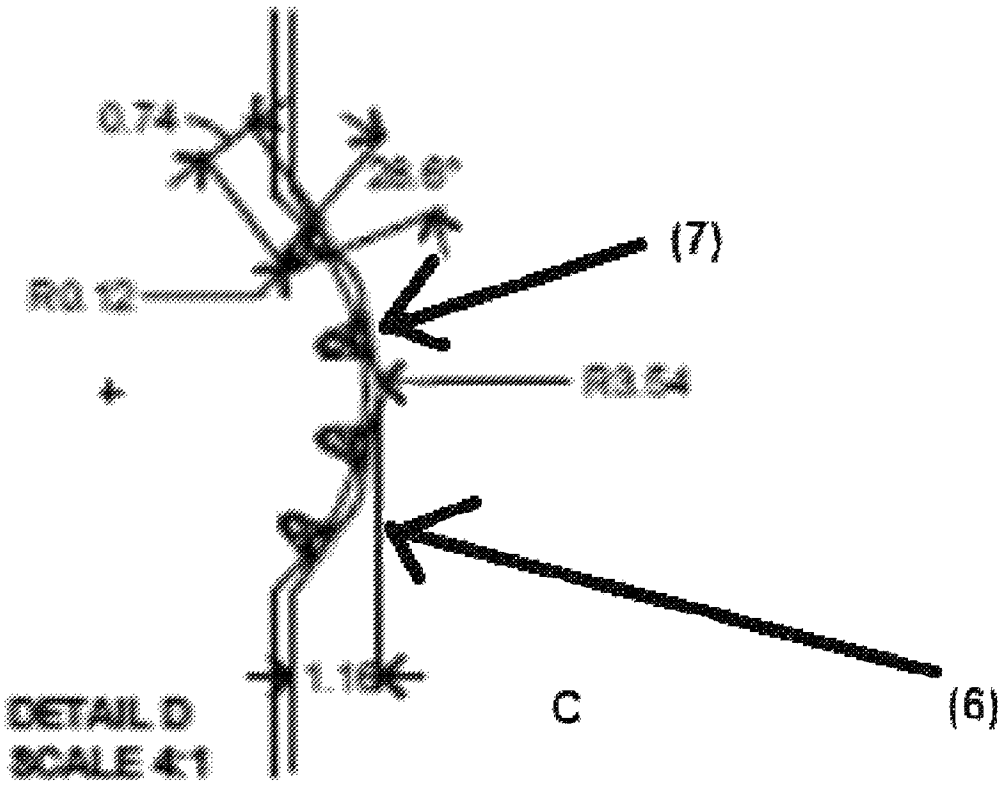

FIGS. 2A, 2B and 2C relate to an exemplary greeting card having mirror-polished edges, a plurality of gemstones (5) embedded into the silver-plated titanium base material (3), and a protruding tab (6) on a side of the greeting card. FIG. 2A represents a top view. FIG. 2B represents a bottom view. FIG. 2C represents a detailed view of the protruding tab (6) having a plurality of gemstones (7) embedded into the protruding tab (6).

Figure 3:
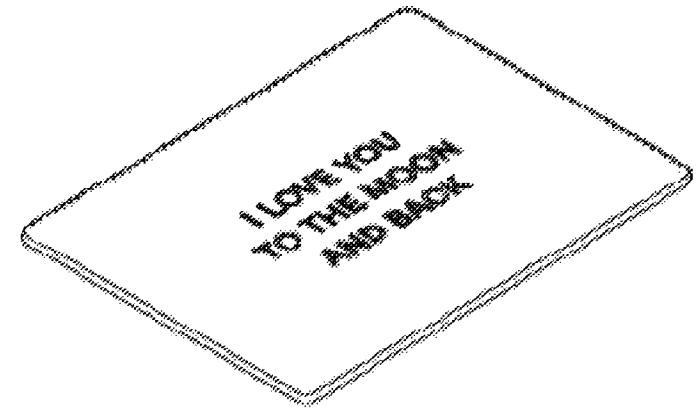
Figure 3:
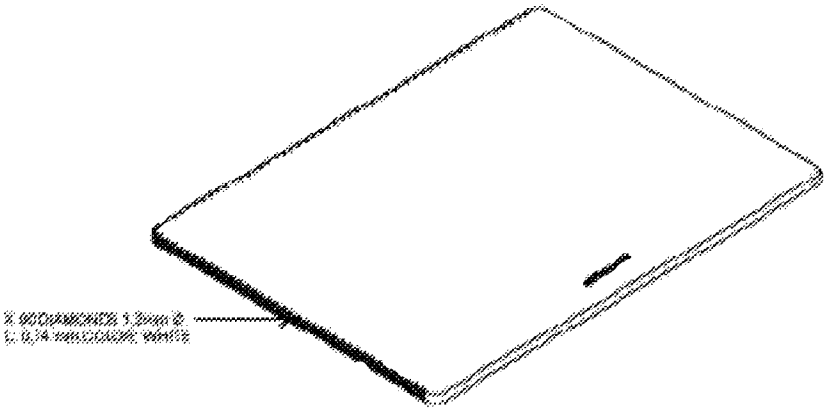
Figure 4:
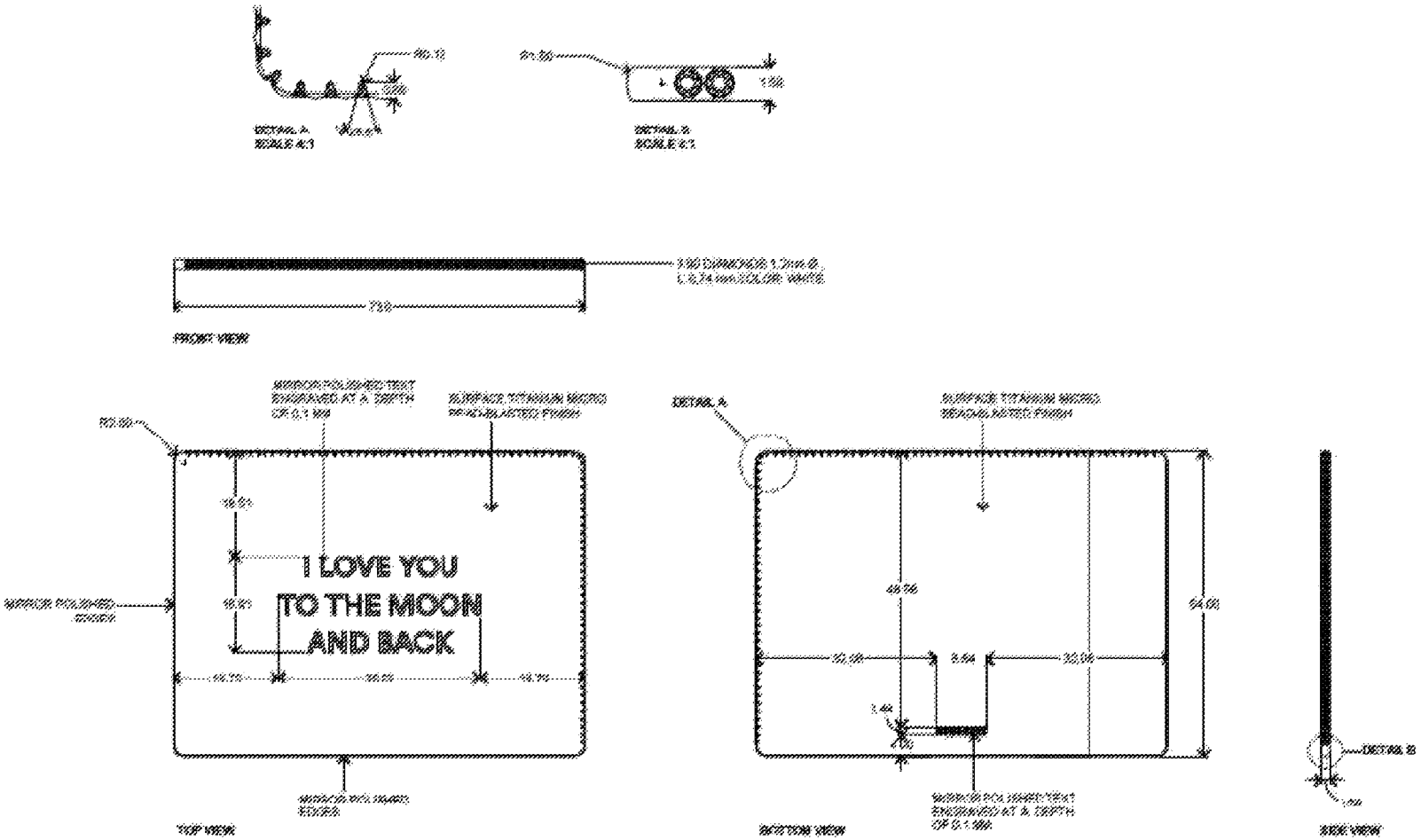
Figure 5:
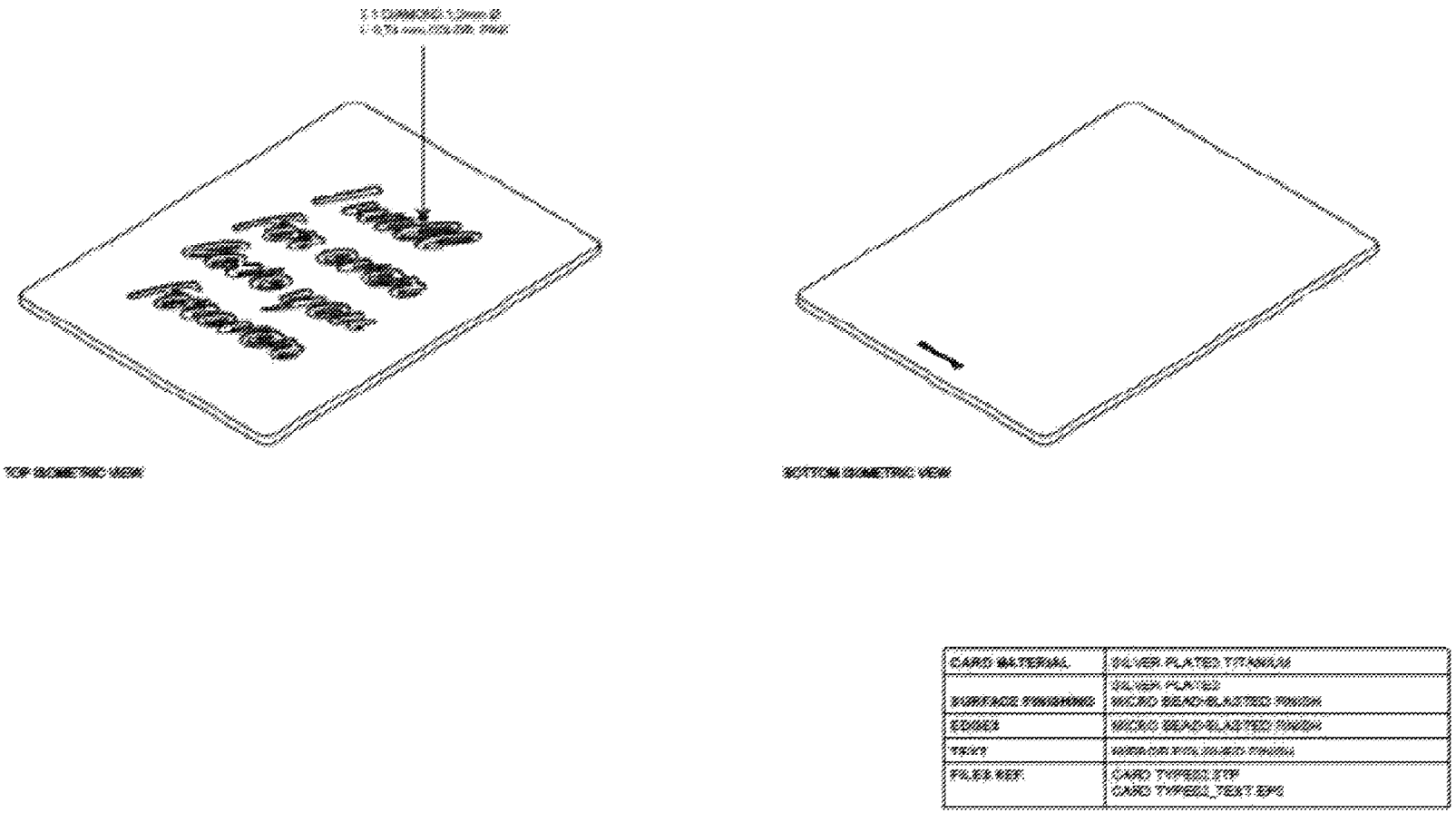
Figure 6:
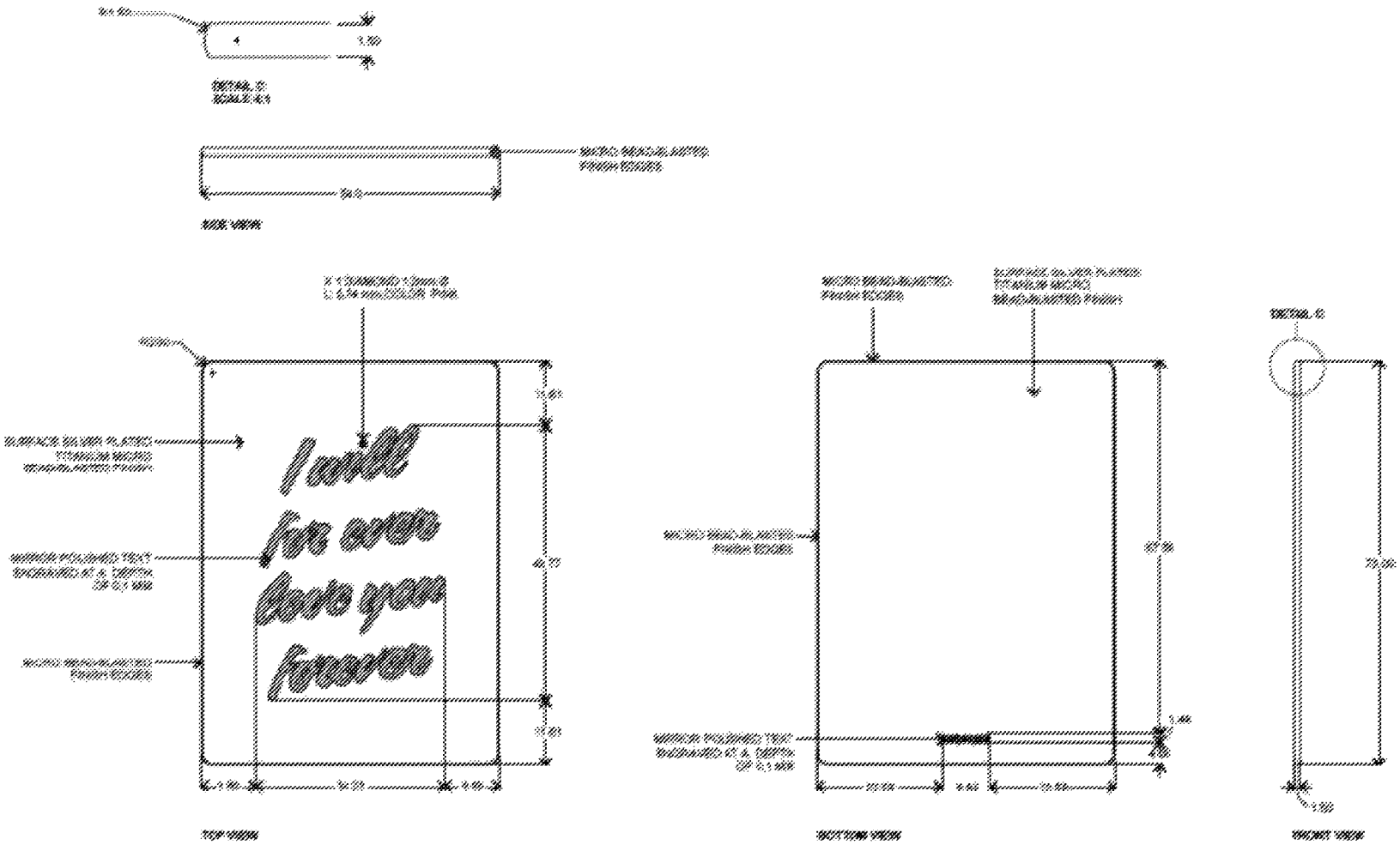
Figure 7:
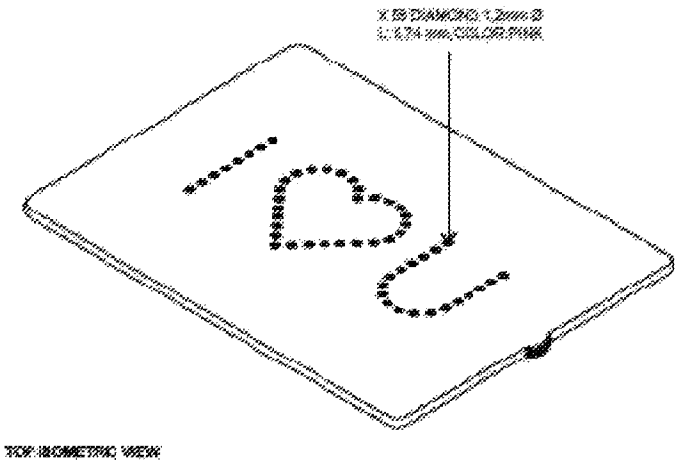
Figure 7:
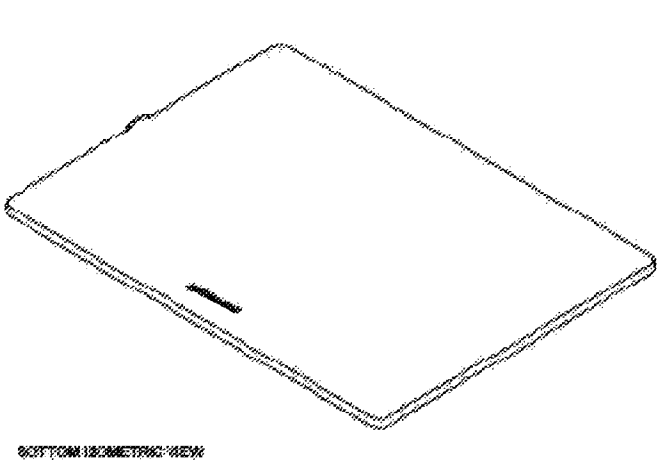
Figure 8:
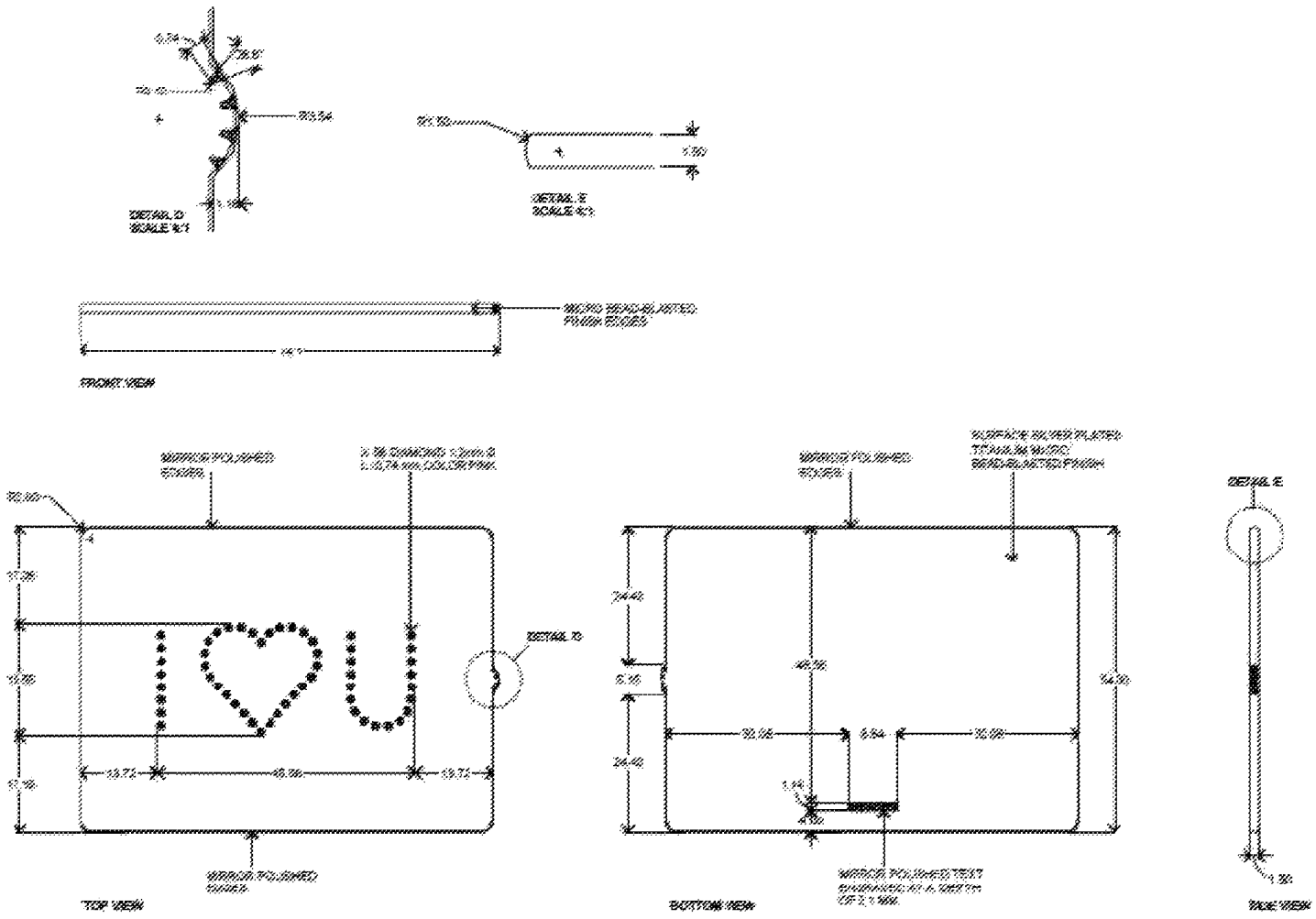
Figure 9:
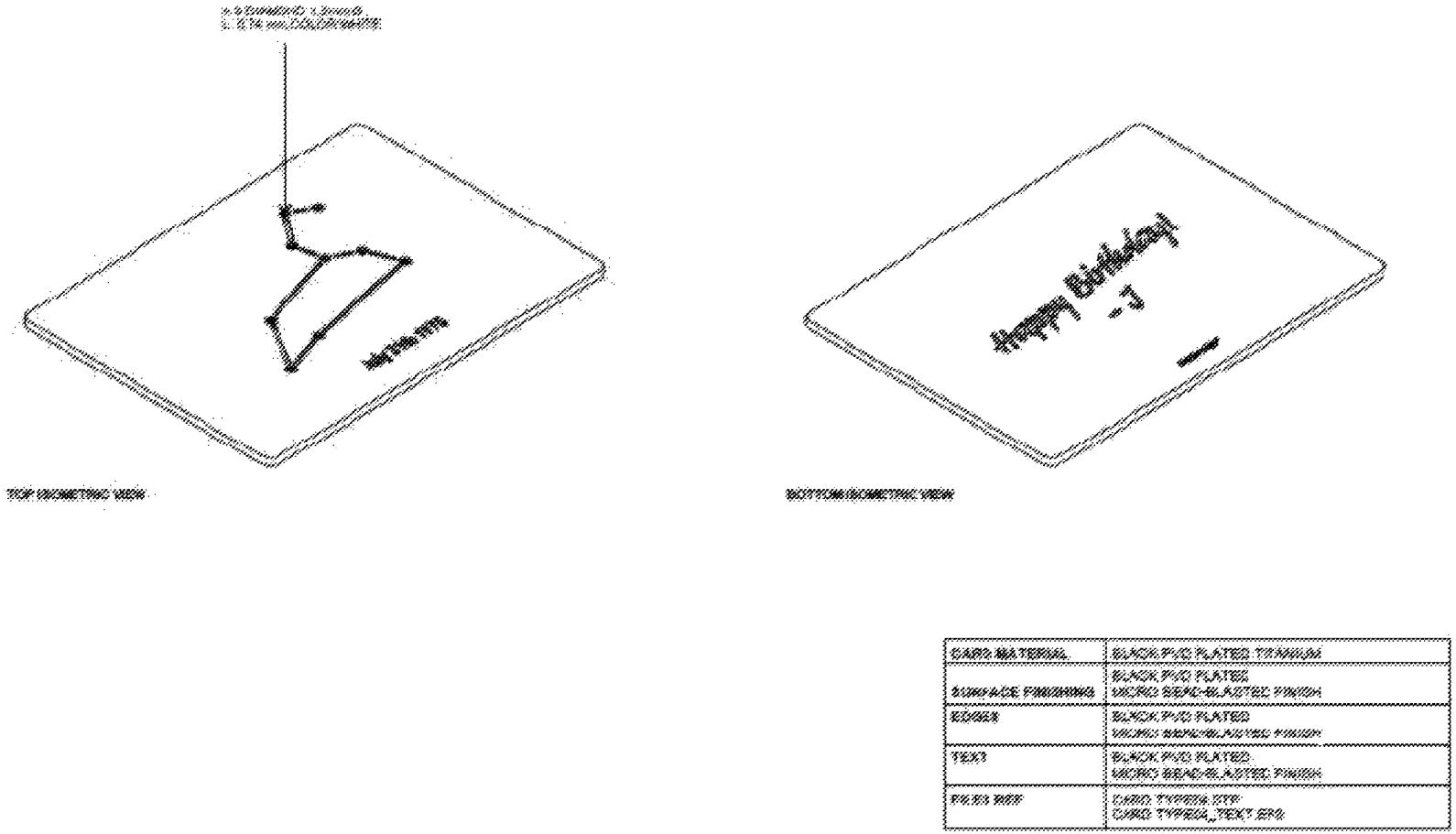
Figure 10:
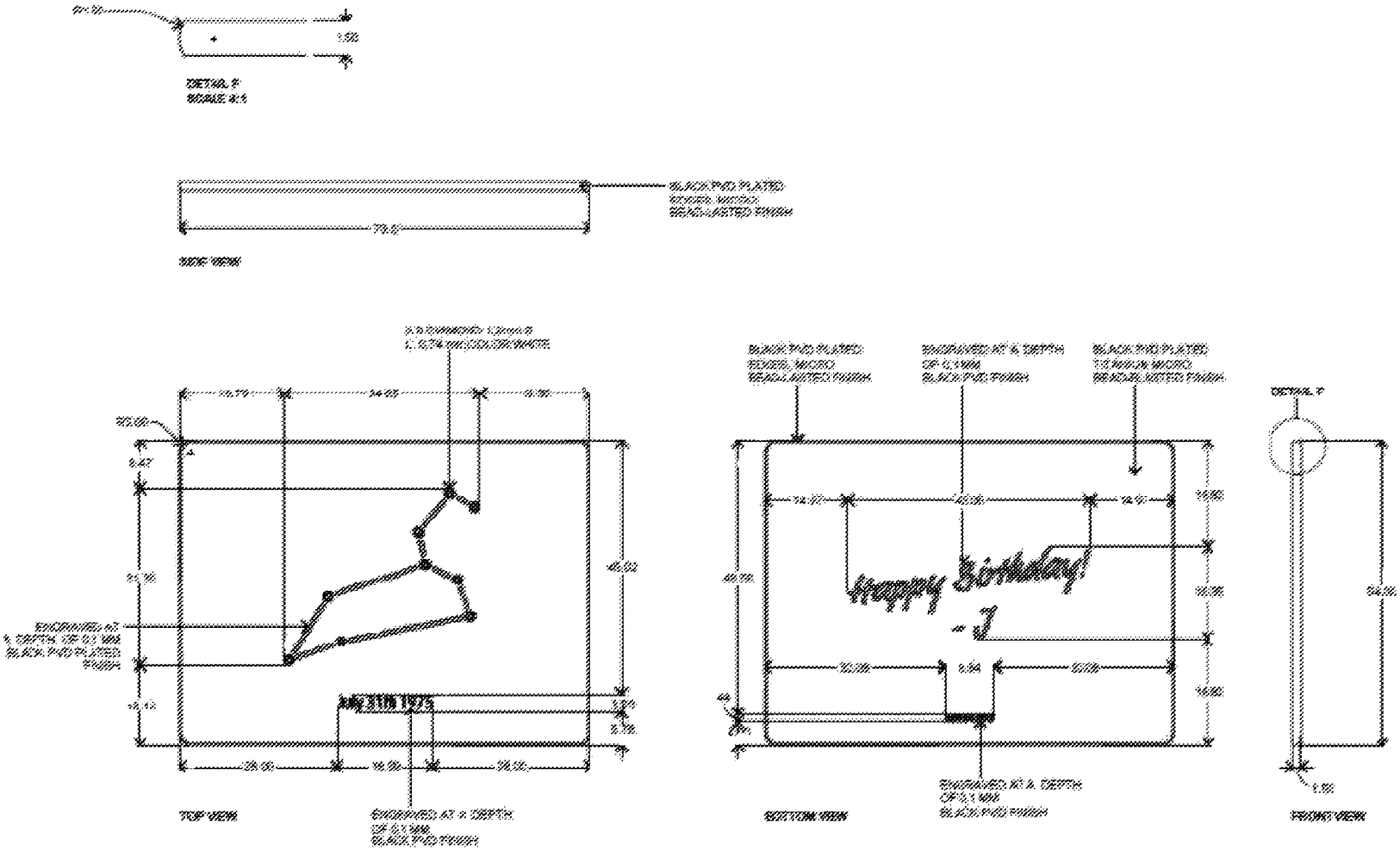
Figure 11:
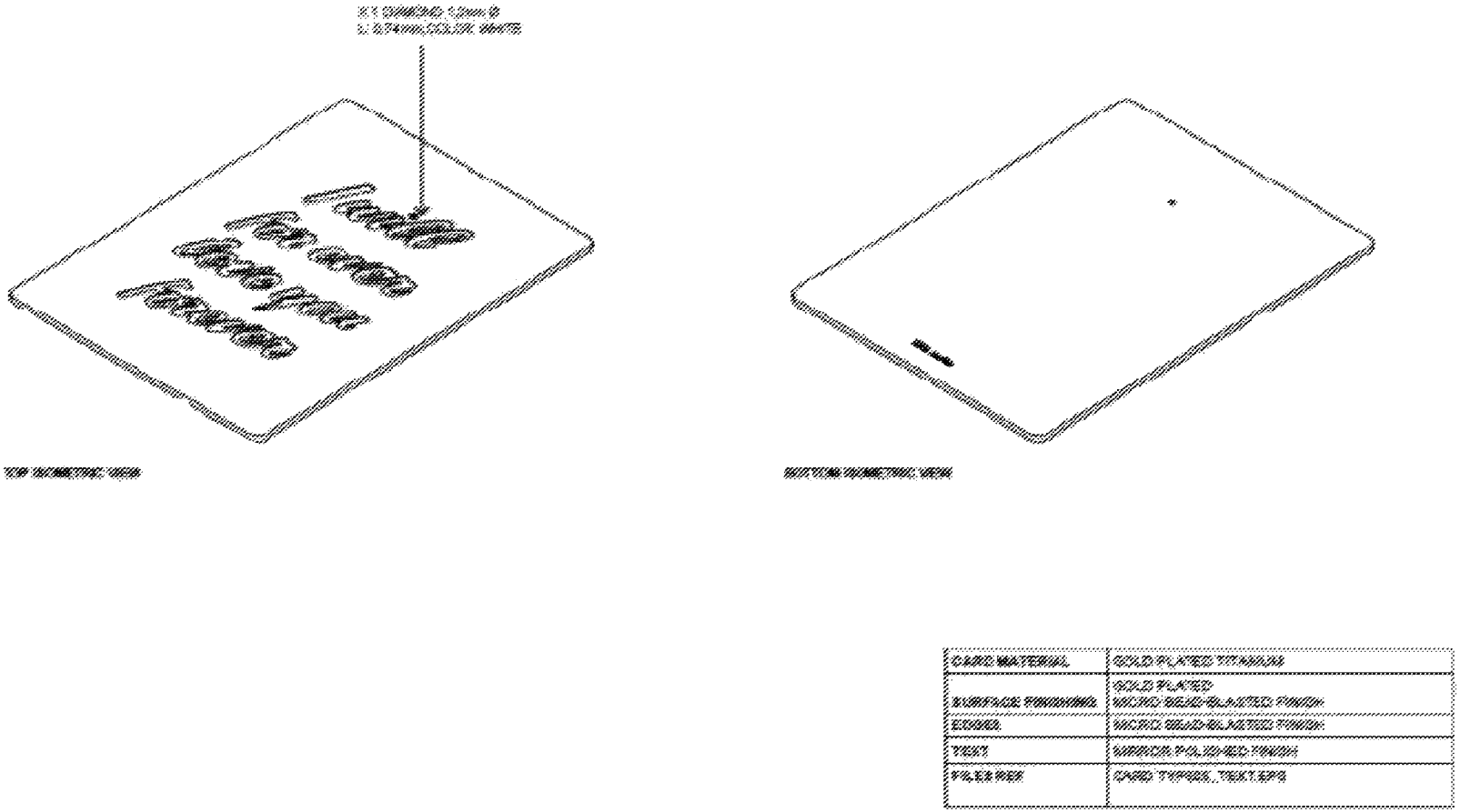
Figure 12:
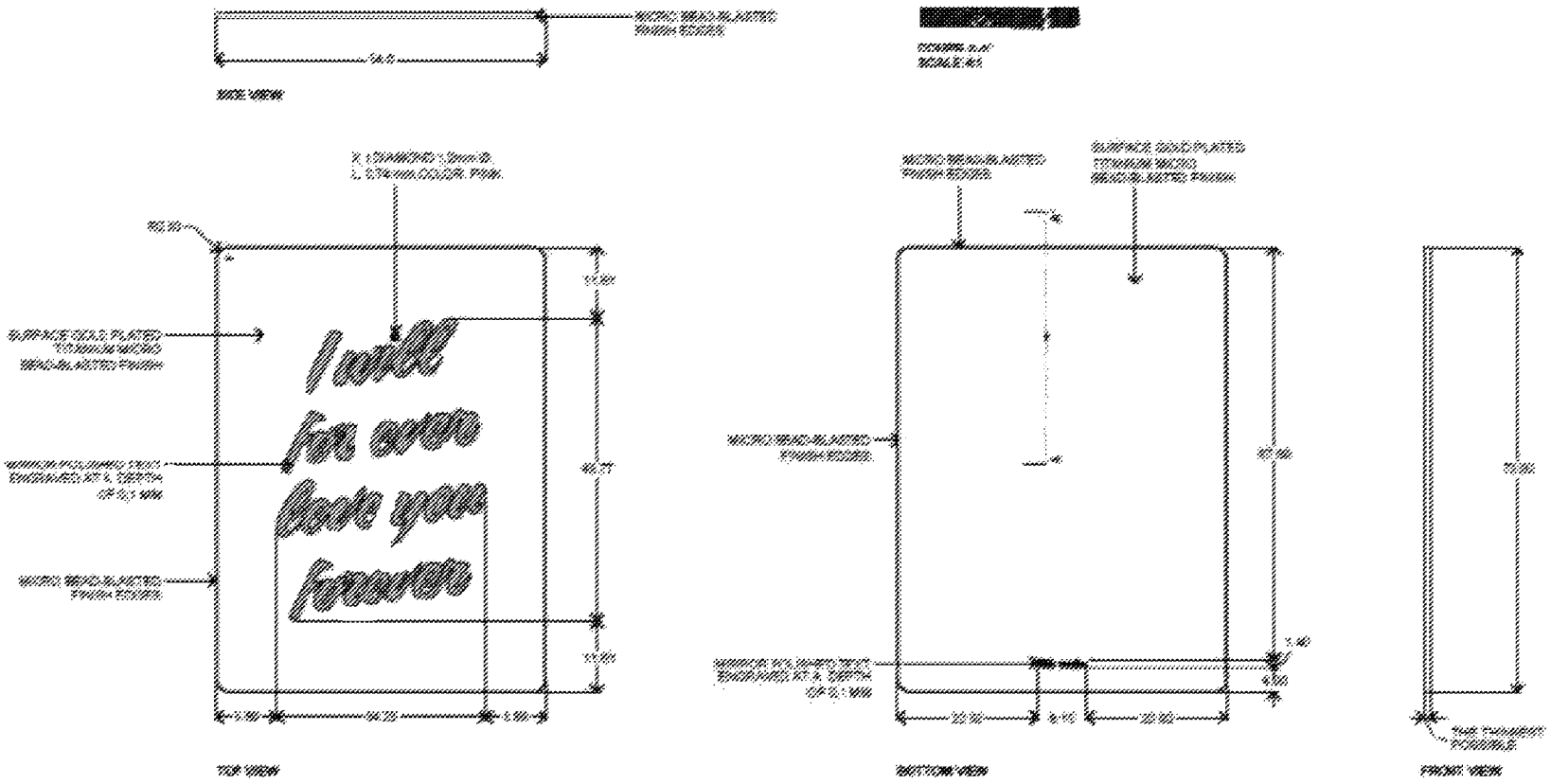
Figure 13:
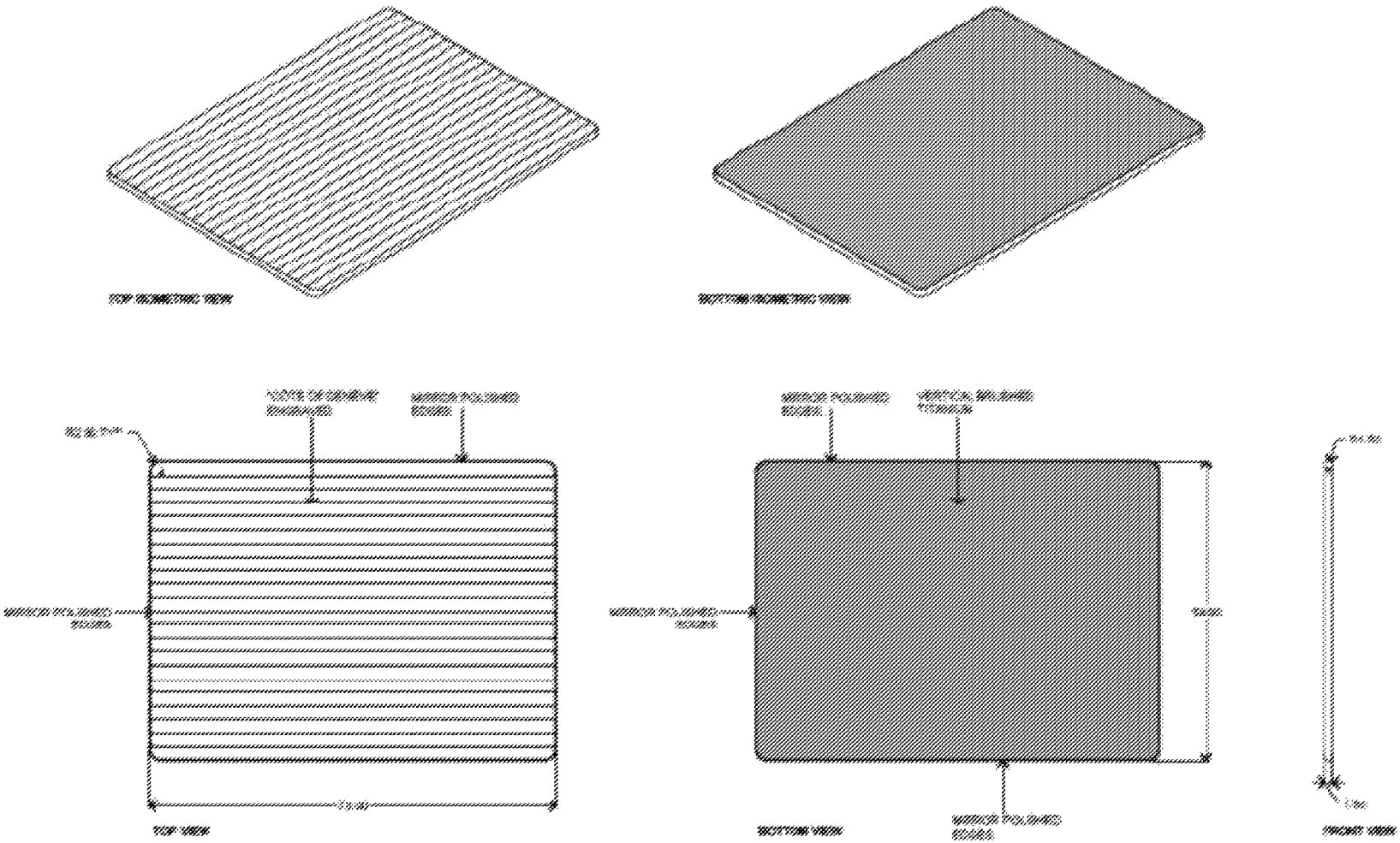
Figure 14:
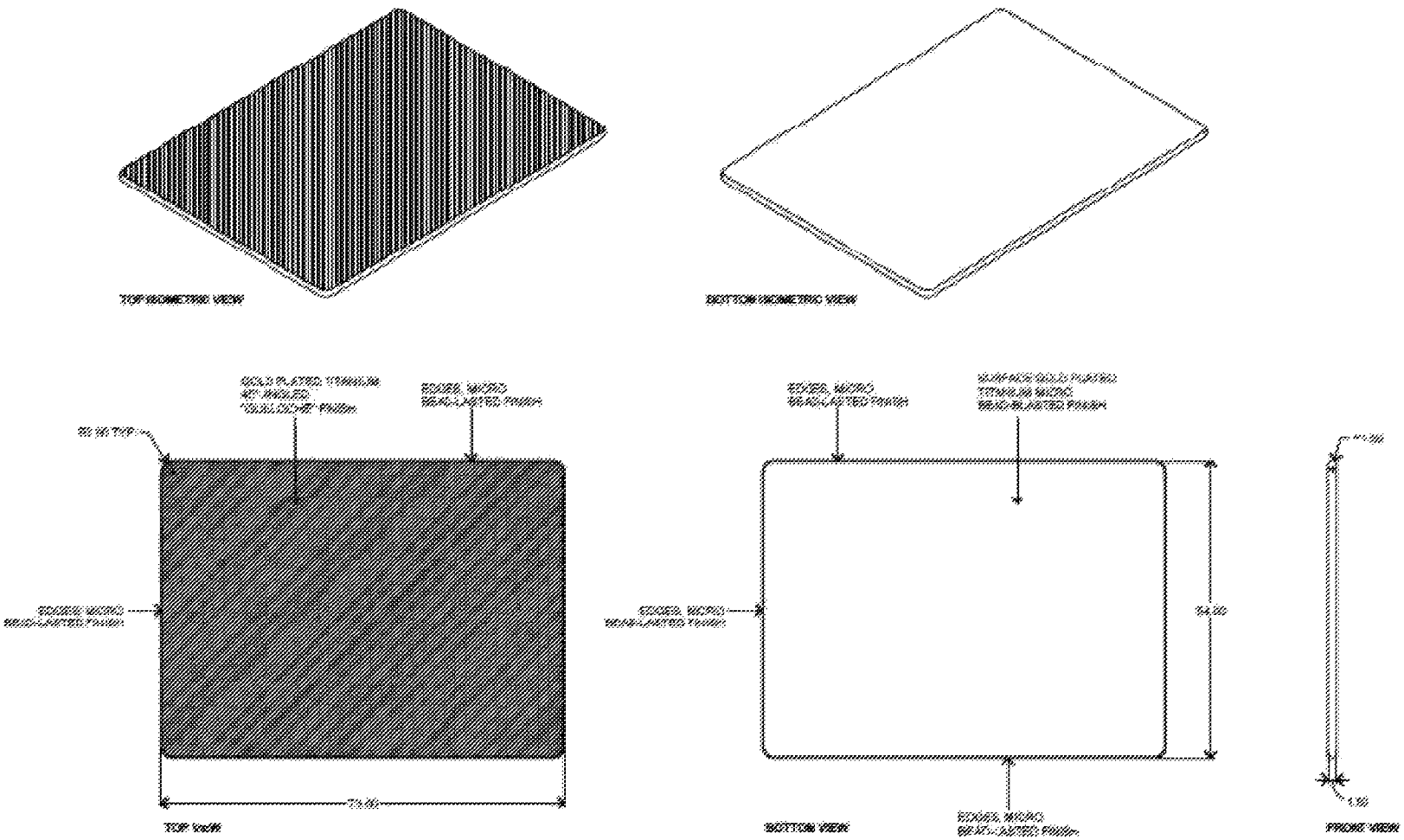

FIGS. 3 and 4 relate to inter alia a plurality of gemstones embedded onto two edges of the greeting card. Although these Figures depict two edges of embedded gemstones, in certain embodiments of the present invention the embedding may be to one or more partial or entire edges.

FIGS. 5, 6, 7, 8, 9, 10, 11, 12, 13, 14 and 15 relate to additional exemplary embodiments of greeting cards pursuant to the present disclosure.

IV. DETAILED DESCRIPTION OF THE INVENTION

The present disclosure relates to a greeting card and can be applied to one or more sides of such a card. The greeting card generally has a base material, for example a base metal or metallic composition, at least one gemstone, e.g. a precious or semi-precious stone, embedded in the base material, and may optionally contain one or more electronic components, for example, capacitive touch element (or other activation button), a display screen, a built-in speaker, and other such elements. FIG. 1 displays one side of an exemplary greeting card, having a display screen (1), display activation button (2), and base material (3).

The base material typically comprises a metal or metallic composition, but may also comprise other durable materials capable of being used with the other elements of the disclosed inventions, and may additionally have its own intrinsic value. Durability of the base material is of importance so that the greeting card, unlike traditional greeting cards, is preservable without fear of damage to the greeting card. Traditional greeting cards made of paper, for example, must be handled with caution if they are to be preserved, and even in such instances, are subject to decay and damage over time due to the underlying organic material. Unlike the traditional greeting cards, the greeting cards of the present disclosure are capable of being presented, worn, or kept in a wallet, for example, without concern of damage to the greeting card.

For example, in preferred embodiments, the base material comprises titanium or titanium alloy, however the base material is not limited as such. The base material should be oxidation and corrosion resistant, and preferably displays good strength, including yield strength, compressive strength, tensile strength, and impact strength. Titanium, including alloys of titanium, represents a preferred durable base material because, in addition to being oxidation and corrosion resistant, it has the highest tensile strength-to-density ratio of any metallic element. The base material can comprise any of the following, explicitly non-limiting metals (including alloys thereof): aluminum, brass, chromium, cobalt, iron, inconel, manganese, molybdenum, steel, titanium, tungsten, vanadium, related compositions, and combinations thereof. In particular, titanium can be alloyed with several other metals to produce strong, lightweight alloys. For example, titanium can be alloyed with iron, aluminum, vanadium, molybdenum, and several other metals. In certain embodiments, the base material may also carry intrinsic value. In some embodiments, the base material comprises precious metals, such as silver, gold, or platinum or their alloys. The base material may also comprise composite materials, including reinforced plastics, fibers (such as aramid), metal composites, and ceramic composites. An example of a suitable composite is carbon fiber. While such base materials are desirable, some do pose challenges for embedding gemstones and other ornamental features. For example, there are particular challenges with embedding diamonds in titanium, particularly thin dimensions of titanium, which require unique techniques and skill.

The base material may be surface-coated or anodized. For example, the base material may be PVD plated, e.g. black-PVD plated titanium, silver-plated, e.g. silver-plated titanium, or may be gold-plated, e.g. gold-plated titanium. Other platings may include, for example, nickel, palladium, platinum, rhodium, zinc, related compositions, and combinations thereof. Non-metallic surface-coatings are possible, and may include polymer coatings, plastic coatings, resin coatings, acrylic coatings, vinyl coatings, painted coatings, or related coatings. For example, titanium may be anodized to create titanium of many different colors, for example, bronze, blue, blue-white, yellow, magenta, cyan, and green titanium, or combinations thereof. It should be appreciated, however, that while various surface coatings and colorings may be desirable, the size and dimensions of the greeting card of the instant invention pose certain challenges in the coating and coloring process, since standard jeweler equipment and procedures may not be suitable. It has been found that the typical processes jewelers employ for jewelry lead to non-uniform coloring and blemishes on the greeting card, which are not desired.

The base material, optionally surface-coated, may also be finished. For example, the base material may be polished, buffed, brushed, ground, or blasted, e.g. microbead-blasted. Polishing typically refers to a more aggressive version of buffing, which typically results in a smoother finish. The finish depends on the desired aesthetic from rough to smooth, and may be patterned, e.g. a striped pattern. For high tensile strength metals such as titanium, typically aluminum oxide (e.g. white or grey aluminum oxide) or a related composition, such as chromium oxide, is used. For brittle substances, silicon carbide is typically used. Mirror finishing typically requires polishing and buffing compounds, typically employing high speed polishing machines.

The greeting card may be engraved or etched, for example with a word or phrase or other symbol or image, such as artwork. These can be customized for specific consumers, e.g. as per customer or purchaser desire. Engraving may occur by a number of means known in the art, including via mechanical means, for example using a pneumatic engraver or a drill bit (e.g. tungsten-carbide or diamond-coated drill bit), by laser engraving, by chemical etching (e.g. through application of an acid), engraving with enamel, photochemical etching, and related methods. The engraving method may be utilized to create a Guilloche pattern on the greeting card. The engraving process may be guided by a computer program or set of readable/executable instructions stored in non-transitory medium.

The base material may be embedded with at least one intrinsically valuable items, such as a gemstone, or other physical item of intrinsic value or extrinsic significance. The gemstone is generally a precious or semi-precious stone, but any suitable gemstone may be used. In one exemplary embodiment, the gemstone comprises a diamond, however the gemstone is not limited as such. The diamonds may be natural, treated, or synthetic. Methods for producing treated and synthetic diamonds are known to one of skill in the art. The diamonds can be white (i.e. natural diamonds) or any other color in addition to pink, for example but not necessarily limited to, yellow diamond, blue diamonds, champagne diamonds, black diamonds, purple diamonds, green diamonds, brown diamonds, red diamonds, grey diamonds, olive diamonds, orange diamonds, and combinations thereof.

The gemstone can comprise any known gemstones, including but not limited to the following: afghanite, agate, alexandrite, amazonite, amber, amethyst, ametrine, ammolite, andalusite, andesine, apatite, aquamarine, aventurine, azurite, bastnasite, benitoite, beryl, bloodstone, calcite, carnelian, cavansite, chalcedony, charoite, chrome diopside, chrysoberyl, chrysocolla, crysoprase, citrine, coral, crinoid, danburite, diamond (e.g. pink diamond), diaspore, diapotase, druzy, emerald, eudialyte, feldspar, fire agate, fluorite, fuchsite, garnet, hackmanite, heliodor, hematite, hiddenite, howlite, iolite, ironstone, jade, jasper, kunzite, kyanite, labradorite, lapis lazuli, larimar, lava rock, lazurite, lepidolite, magnetite, malachite, meteorite, moldavite, moonstone, morganite, obsidian, onyx, opal/opalite, orthoclase, pearl (e.g. akoya or black pearl), peridot, petalite, pietersite, prasiolite, prehnite, pyrite, quartz, rhodochrosite, rhodonite, rhyolite, rubelite, ruby, sapphire, scapolite, selenite, septarian, seraphinite, serpentine, shellstone, sillimanite, sodalite, spectrolite, sphalerite, sphene, spinel, spodumene, stichtite, sugilite, sunstone, tanzanite, tekite, tiffany stone, tiger eye, tiger iron, topaz, tourmaline, tremolite, triphane, turkiyenite, turquoise, variscite, verdite, zebra rock, zircon, zoisite, and combinations thereof.

In preferred embodiments, the greeting card contains a plurality of gemstones, the gemstones being embedded into one or more surfaces of the base material (e.g. one or more sides and/or edges of the base material) in a pre-determined pattern, for example, an image or message, such as depicted in FIGS. 2-15. Individual gemstones in the plurality of gemstones may comprise different gemstones. Thus, the greeting card may have a message that is engraved into the card, or may have a message that is formed by gemstones (e.g. diamonds) that are embedded into the base material, or may have a combination of both. In addition, or as an alternative, to being embedded in one or more sides of the greeting card, individual gemstones may be embedded along one or more edges of the greeting card, such as depicted in FIGS. 2-4. In certain preferred embodiments, one or more portions of one or more edges have gemstones embedded therein. In one exemplary embodiment, one or two complete edges have gemstones embedded therein. In certain embodiments, the greeting card may have one or more protruding tabs from one or more edges, which may have gemstones embedded therein, such as depicted in FIG. 2. One advantage to having gemstones embedded along one or more edges is that such features may be seen even when the greeting card is stored in a wallet, purse, or carrying case, as long as one edge is showing. For example, a greeting card of the present invention stored in a wallet would have at least one edge visible whenever the wallet is opened, even if the card is not removed. Not only does this serve the function of reminding the holder of the sentimental (and intrinsic) value of the greeting card even when the greeting card is not removed, but also it aids the holder in quickly locating the greeting card among other items stored in the wallet, purse, etc.

The gemstones may be of any dimension, size, and weight that they may be permanently embedded into the greeting card. In preferred embodiments, the gemstones are of a dimension such that they do not protrude above the surface plane of the side of the base material within which they are embedded. In alternative embodiments, it may be desirable to have the gemstones dimensioned such that when embedded along the an edge of the greeting card they do protrude above the surface plane of the edge. While the gemstones may have any dimension that will fit on and is capable of being embedded in the greeting card, in preferred embodiments, the gemstones have a diameter of between about 1.0 mm and 1.1 mm.

The greeting card may contain one or more electronic components. The electronic components may be housed entirely inside the greeting card, or they may be exposed (either partially or fully) on a surface or surfaces (e.g. one or more sides) of the greeting card. The electronic components may be interconnected (or operatively linked) through wiring or circuitry to one another, and are optionally connected to a power source, for example, a battery. The wiring and/or circuitry may be housed entirely inside the greeting card, or they may be exposed (either partially or fully) on a surface of the greeting card. Exemplary electronic components include an activation button and display screen (See FIG. 1). The display screen may comprise an LCD screen, LED screen (including OLED), or electronic ink (E-ink) display, and depending on the screen type may or may not be backlit. The activation button may be a physical button that actuates upon application of external force, or may alternatively comprise a capacitive touchscreen. The activation button may be interconnected/operatively linked to any number of additional electronic components described herein.

Other electronic components may include antennas, speakers, headphone jacks, near field communication (NFC) devices, radio-frequency identification (RFID) tags/chips, Wi-Fi dongles, microphone, Bluetooth adapter/dongle, Bluetooth low energy (BLE), solar cell, fingerprint sensor, LED light/flashlight, laser, camera lens, display screen and related components.

In particular, the greeting card may utilize Bluetooth low energy (BLE) technology which may allow the greeting card to communicate with other electronic devices, for example, a mobile device such as a cell phone, tablet, laptop, or other computing device. In some embodiments, the mobile device contains software or executable instructions, such as in the form of an app, which allows the user or a third party to modify or interact with the greeting card. For example, a greeting card having BLE technology and a display screen, for example but not necessarily an electronic ink screen, may allow a user or third party to transmit, change, or modify a message on a display screen of the greeting card with software contained on that user or third party's mobile device. In some embodiments, the greeting card comprises a cellular data receiver or transmitter, which enables the greeting card to receive commands and, with a display screen, display messages, including text messages, or other custom displays. Such commands, messages, and displays may be received via SMS text messages, mobile applications compatible with the greeting card, or other messaging functionality from cellular phones or computers.

The greeting card may include a memory storage device, for example read-only memory (ROM) having pre-loaded executable files or random access memory (RAM), or alternatively a flash memory drive, wherein the greeting card may further comprise an i/o port, for example, a universal serial bus (USB, including micro USB, USBc, USB 3.0 etc.) port, thunderbolt port, or related interface. In such embodiments the greeting card may double function as a storage drive for the user, or may be pre-loaded with additional greetings, messages or files for the recipient of the greeting card. For example, the greeting card could be programmed to automatically display a greeting at a specific time, to play a specific song out of a speaker when an activation button is pressed, or a user could record a voice message into a microphone, which then is played through a speaker when an activation button is pressed. This could be in combination with a display screen, which likewise, may or may not contain a customized or automatic message. The preferred embodiment of the greeting card has the novel capability of allowing receipt of post gift new greeting messages sent and received live in real time. The diamond/gemstone and other intrinsic value environment of the card may make the new greeting as fresh and personal as the original card. Preloaded executable files in the greeting card may also serve to run the various electronic components, and may be customizable depending on the sender's or user need.

The greeting card may additionally comprise a power source, e.g. a battery. The battery may be housed entirely inside the greeting card, or it may be exposed (either partially or fully) on a surface of the greeting card. The battery may be a rechargeable battery, or a non-rechargeable battery, e.g. a watch battery. The battery may be interconnected to any number of electronic components described herein. Common rechargeable battery types include, but are not limited to, lead acid gel batteries, lithium-ion (Li-ion) batteries, including but not limited to lithium-ion polymer batteries, nickel-cadmium (NiCd or Nicad) batteries, and nickel metal hydride batteries. Common non-rechargeable batteries include, but are not limited to, alkaline batteries, carbon zinc batteries, lithium batteries, mercury batteries, silver oxide batteries, and zinc air batteries. In instances where the greeting card comprises a rechargeable battery, the greeting card may (but not necessarily) may further comprise a charging port, which may or may not be a USB charging port. Alternatively, the greeting card may comprise electronic components for wireless inductive (Qi) charging, or may comprise a solar cell as disclosed above.

The greeting card may be manufactured from a unitary, solid base material upon which all other features are embedded or affixed. The greeting card may also be manufactured with two or more base material portions that are affixed together to house other features. For example, electronic components could be inserted into a cavity of a unitary base material, or electronic components could be housed between two or more base material portions.

Figure 15:
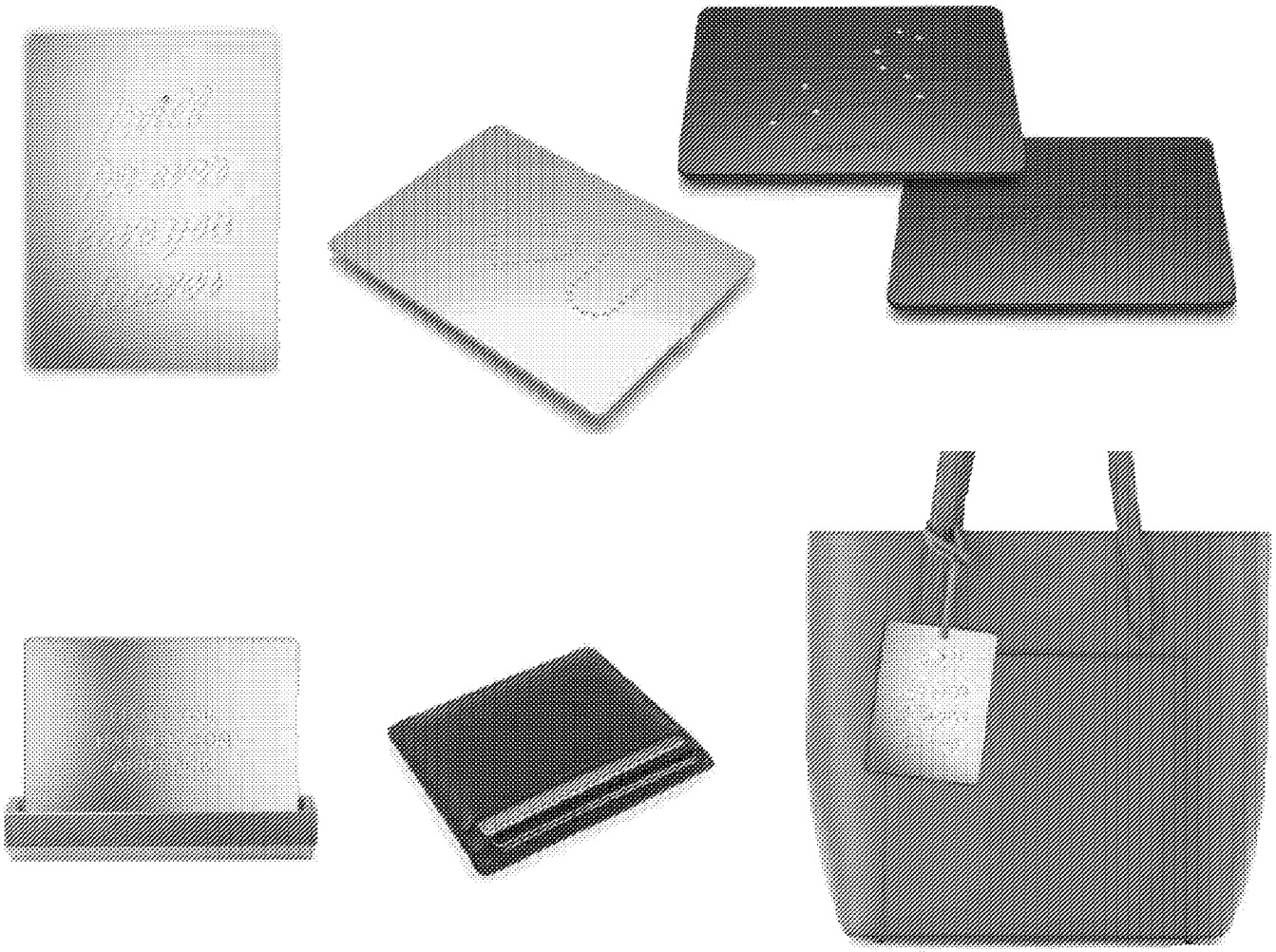

The greeting card may additional have means for affixing or attaching the greeting card to another object. For example, as depicted in FIG. 15, the greeting card may have one or more apertures through which a strap or hook could be inserted. The apertures may be through the face of the greeting card or through a protruding tab. In this manner, the greeting card could be used as a decorative tag on a handbag, purse, briefcase, luggage, or the like. Similarly, the greeting card could be hung decoratively in a home or office or attached to be wearable on clothing; e.g. the greeting card may be wearable by a user. Additionally, the greeting card may have one or more aperture(s), through which, for example, threading or similar materials such as chains could pass through to allow the greeting card to be hung. In an alternative embodiment, the greeting card may have an integrated magnet, permitting the greeting card to be magnetically attached to a ferromagnetic surface. In another alternative embodiment, the base material may comprise a ferromagnetic metal, enabling the greeting card to be magnetically attached to a magnetic surface.

The overall shape of the greeting card may be any geometric shape or non-geometric shape. In preferred embodiments, the shape of the greeting card is rectangular with rounded edges. In some embodiments, the greeting card may have a protrusion (e.g. a tab) on a side of the greeting card see, e.g., FIG. 2A, 2B). In some embodiments the protrusion may be embedded with at least one gemstone, for example, as shown in FIG. 2C. The geometric shape (length and width, notwithstanding thickness) of the greeting card may be, for example, a rectangle, square, triangle (equilateral, isosceles, scalene, right, obtuse, acute), rhombus, parallelogram, trapezoid, kite, trapezium, pentagon, hexagon, heptagon, octagon, nonagon, decagon, circle, ellipse, crescent, or any other regular or irregular polygon. The edges of the greeting card may be smooth or rounded. In some embodiments, the greeting card in generally in the shape of a regular polygon, such as a rectangle, with one or more protruding tabs on one or more sides of the greeting card. In a preferred embodiment the greeting card is a flat shape of the foregoing dimensions having only two sides (i.e., a front side and back side). In other embodiments, the greeting card may be folded or bent, such as in the shape of a traditional paper greeting card (e.g., two rectangular panels connected on one side) or any other multi-dimensional shape.

The dimensions of the greeting card do not necessarily have any maximum dimensional limitation. However, preferably the greeting card has a thickness sufficient to withstand ordinary force, and length and width that are similar to but slightly smaller than other types of cards typically carried in a wallet or purse (so as to be easily distinguishable from such items) for ease of carrying in a wallet, or similar to a luggage tag for ease of affixing to a handbag, purse, or keychain, or for ease of display. Having length and width dimensions smaller than a typical credit card, coupled with a distinct look and feel, permits the greeting card to be easily distinguished from other cards typically carried in a wallet or purse, which aids the holder in locating the greeting card quickly so that it can be removed or not removed as desired. The difference in dimensions (and look and feel) also make the greeting card noticeable so that even if not removed it still is noticed by the holder and may remind the holder of the sentimental (and intrinsic) value of the greeting card. The greeting card will typically (but not necessarily) have dimensions that are smaller than that of traditional greeting cards. For example, but not necessarily, the greeting card may have a first dimension (length or width) that is between about 25 to about 150 mm, between about 50 and about 125 mm, between about 50 and about 100 mm, between about 50 and about 75 mm, between about 75 and about 100 mm, between about 60 and about 80 mm, between about 80 and about 100 mm, between about 70 and about 80 mm, between about 65 and about 85 mm, between about 70 and about 90 mm, and any intervening ranges therein. Exemplary greeting cards have a first dimension that ranges from about 73 mm to about 85 mm. The greeting card may have a second dimension (length or width, depending on the first dimension) between about 15 and about 100 mm, between about 20 and about 80 mm, about 25 to about 75 mm, about 25 to about 60 mm, about 25 to about 50 mm, about 40 to about 60 mm, about 45 to about 55 mm, about 50 mm to about 55 mm, about 50 mm to about 60 mm, about and any intervening ranges therein. Exemplary greeting cards have a second dimension of about 54 mm. The thickness of the greeting card may be, but is explicitly not limited to, about 0.5 to about 5.0 mm, about 0.75 to about 4.0 mm, about 1.0 mm to about 1.5 mm, about 0.75 to about 1.5 mm, about 1.0 mm to about 2.0 mm, about 0.75 to about 2.0 mm, about 1.5 to about 2.0 mm, and any intervening ranges therein. In a preferred embodiment, the greeting card has a thickness of about 1.2 mm to about 1.3 mm, and more specifically about 1.25 mm. The thickness is preferably such that, based on the composition of the base material, the greeting card may withstand ordinary handling without deformation, yet also is thin enough so as to not be undesirably heavy or take up too much space in a wallet or purse.

What is claimed is:

1. A greeting card comprising:

a base material comprising titanium, a titanium alloy, aluminum, brass, chromium, iron, manganese, molybdenum, steel, tungsten, vanadium, silver, gold, platinum, foils of the foregoing, or combinations thereof and defining a first major surface and one or more sides of the greeting card;

a second major surface opposite the first major surface and spaced therefrom by one or more sides, thereby defining a housing having an interior void;

a display screen defining part of either the first major surface or the second major surface and configured to display text, images, or combinations thereof;

a wireless data receiver located within the interior void in electrical communication with the display screen;

a power source located within the interior void and in electrical communication with the display screen and the wireless data receiver;

wherein the wireless data receiver is configured to:

receive a first communication from an external electronic device, wherein the first communication includes information describing an initial message to be displayed on the display screen; and receive, subsequent in time to receipt of the initial message, a second real time communication from the same external electronic device or a different external electronic device, wherein the second communication includes information describing a second message;

a non-transitory memory storage device having preloaded executable instructions to display the first communication on the display screen, to change or modify the initial message based on the second real-time communication, and to display the second message on the display screen; and one or more gemstones each set in one of the one or more sides with an upper surface of each gemstone generally flush with the one or more sides and with an opposing end of the one or more gemstones positioned inward within the interior void.

2. The greeting card of claim 1, further comprising one or more of an antenna, speaker, headphone jack, microphone, solar cell, fingerprint sensor, LED light/flashlight, laser, and camera lens.

3. The greeting card of claim 1, wherein the wireless data receiver comprises a Bluetooth adapter or dongle, and the Bluetooth adapter or dongle comprises Bluetooth low energy (BLE) technology.

4. The greeting card of claim 1, wherein the power source is a rechargeable battery and the greeting card further comprising a charging port or inductive charger for the power source.

5. The greeting card of claim 1, wherein the base material is surface-coated.

6. The greeting card of claim 5, wherein the surface coating is one of PVD, silver, gold, platinum, or titanium foil.

7. The greeting card of claim 1, wherein the greeting card is a single, non-foldable flat sheet and has an overall geometric shape resembling a rectangle.

8. The greeting card of claim 7, wherein the greeting card has a thickness in a range of 1.2 mm to 5 mm.

9. The greeting card of claim 7, wherein the greeting card has a thickness in a range of 1.2 mm to 3.5 mm.

10. The greeting card of claim 7, wherein the greeting card has a length and a width smaller than a credit card.

11. The greeting card of claim 8, further comprising a protruding tab extending from a first end of the greeting card and defining a portion of a side of the one or more sides.

12. The greeting card of claim 11, wherein the protruding tab defines an aperture configured to attach the card to another object.

13. The greeting card of claim 1, wherein the wireless data receiver is selected from the group consisting of a Wi-Fi dongle, a text message receiver, a cellular data receiver, a Bluetooth adapter/dongle, a near field communication (NFC) device, a radio-frequency identification (RFID) tag/chip, and combinations thereof.

14. The greeting card of claim 1, comprising an activation button in either the first or second major surface and in electrical operative communication with the power source.

15. The greeting card of claim 1, comprising a plurality of the one or more gemstones in the first major surface and in the one or more sides.

16. The greeting card of claim 15, wherein the plurality of the one or more gemstones are in a pre-determined pattern in the first major surface that creates an indicia of a message alone or in combination with an engraving.

17. The greeting card of claim 16, wherein the indicia of a message is selected from words, images, and combinations thereof.

18. The greeting card of claim 1, wherein the wireless data receiver is configured to communication with an app operating on the external electronic device.

19. A greeting card comprising:

a base material comprising a metal or metal alloy that defines a first major surface and one or more sides of the greeting card, wherein the greeting card is dimensioned similar to or smaller than a credit card or a luggage tag and has a thickness in a range of 1.2 mm to 5 mm;

a second major surface opposite the first major surface and spaced therefrom by the one or more sides, thereby defining an interior housing;

one or a plurality of gemstones fixedly set in one of the one or more sides in direct contact with the metal or metal alloy with an upper surface of each gemstone generally flush with one of the one or more sides of the greeting card and with an opposing end of each gemstone positioned inward within the interior housing;

a display screen defining part of in-either the first major surface or the second major surface and configured to display text, images, or combinations thereof;

a wireless data receiver located within the interior housing in electrical communication with the display screen;

a power source located within the interior housing and in electrical communication with the display screen and the wireless data receiver;

wherein the wireless data receiver is configured to:

receive a first communication from an external electronic device, wherein the first communication includes information describing an initial message to be displayed on the display screen; and receive, subsequent in time to receipt of the initial message, a second real-time communication from the same external electronic device or a different external electronic device, wherein the second communication includes information describing a second message;

a non-transitory memory storage device having preloaded executable instructions to display the first communication on the display screen, to change or modify the initial message based on the second real-time communication; and display the second message on the display screen.

20. The greeting card of claim 19, wherein the wireless data receiver is selected from the group consisting of a Wi-Fi dongle, a text message receiver, a cellular data receiver, a Bluetooth adapter/dongle, a near field communication (NFC) device, a radio-frequency identification (RFID) tag/chip, and combinations thereof.

21. The greeting card of claim 20, wherein the wireless data receiver comprises a Bluetooth adapter or dongle, and the Bluetooth adapter or dongle comprises Bluetooth low energy (BLE) technology.

22. The greeting card of claim 20, wherein the power source is a rechargeable battery and the greeting card further comprising a charging port or inductive charger for the power source.

23. The greeting card of claim 19, comprising an engraving in the first major surface; wherein the one or the plurality of gemstones and the engraving create an indicia of a message.

24. The greeting card of claim 19, wherein the greeting card is a non-foldable flat sheet.

25. The greeting card of claim 19, further comprising one or more of a speaker, a headphone jack, and an activation button; wherein the first message and the second message comprises text, images, sound, or combinations thereof.

* * * * *